US005639246A

United States Patent [19]

Holmes

[11] Patent Number: 5,639,246

[45] Date of Patent: Jun. 17, 1997

[54] ELECTRICAL CONNECTOR FOR TRAILER

[75] Inventor: William T. Holmes, Jackson, N.J.

[73] Assignee: General Automotive Specialty Co., Inc., North Brunswick, N.J.

[21] Appl. No.: 493,142

[22] Filed: Jun. 21, 1995

[51] Int. Cl.[6] ..... H01R 33/00

[52] U.S. Cl. ..... 439/35; 439/503; 439/505

[58] Field of Search ..... 439/35, 614, 419, 439/502, 503, 505

[56] References Cited

U.S. PATENT DOCUMENTS

| | | | |
|---|---|---|---|
| 3,137,448 | 6/1964 | Holzhause | 439/35 |
| 3,335,389 | 8/1967 | Reichardt | 439/35 |
| 3,400,293 | 9/1968 | Reichardt | 439/503 |
| 3,458,849 | 7/1969 | Marks et al. | 439/35 |
| 4,842,524 | 6/1989 | Hopkins et al. | 439/35 |
| 4,941,844 | 7/1990 | Bowden et al. | 439/425 |
| 5,339,232 | 8/1994 | Lin | 362/391 |

*Primary Examiner*—Gary F. Paumen
*Assistant Examiner*—Christopher Goins
*Attorney, Agent, or Firm*—Darby & Darby

[57] ABSTRACT

A connection device for a trailer light system, having a socket simulating a vehicle lamp socket and a plug joined to said socket simulating the base of a lamp, with wires joined directly or indirectly to said simulated socket or simulated plug for energizing the trailer light circuit.

7 Claims, 2 Drawing Sheets

ELECTRICAL CONNECTOR FOR TRAILER

FIELD OF THE INVENTION

The present invention relates generally to connections for providing trailers with electrical power for lights, and specifically to connections providing easy and reliable installation.

BACKGROUND OF THE INVENTION

Federal motor vehicle standards require that tail, brake and turn signal lamps be mounted on the rear of all trailers. Since trailers generally have no power sources, it is necessary to tap into the towing vehicle's power system to provide such power, particularly in correspondence with the energization of the lamps on the towing vehicle. Thus when the towing vehicle driver applies pressure to the vehicle's foot brake, not only are the vehicle's brake lights illuminated, but it is required that the trailer's brake lights also shall be illuminated, and be extinguished when the vehicle's brake lights are extinguished. The same applies to the turn signal lights and tail lights.

In some instances, where a vehicle light system includes a master separable connector, a T-tap connector device such as shown in U.S. Pat. No. 4,842,524 may be used. However, in many cases no such separable connector is present. In such cases, it has been necessary to locate each individual wire (such as for tail light, brake light and turn signal light) by a trial and error method, generally requiring two persons, one to activate the appropriate light from the driver's position and the other to test the wiring at the rear of the vehicle. After the appropriate wire is determined it may be tapped by any of a number of ways. One way is to cut the wire, strip its ends of insulation, and rejoin the ends with a third wire leading to the trailer. Another way is to remove insulation from a short section of wire, and wrap and solder the third wire to the bared wire. Still another way is to use an insulation-displacing tap, as shown in U.S. Pat. No. 4,941,844 and sold by 3M Company.

All these methods have the drawback of requiring that the wire related to each function (tail light, brake light, turn light) be identified, requiring two persons, and then providing a third wire and connecting it to the corresponding wire of the trailer wiring harness, after similarly identifying it. Such connections are time-consuming, require considerable skill and are not always reliable.

SUMMARY OF THE INVENTION

The present invention provides an apparatus and method for connecting to the vehicle lighting system without the need to identify individual wires, or to cut, strip, wrap or solder wires, or to use separate devices to pierce or displace insulation to contact the conductor.

According to the invention, a connection device is provided having a wiring harness with a first end identical to or simulating the existing socket for an indicator lamp (e.g., the tail light, brake light or turn light) of the towing vehicle. The device has a second end simulating the contact end or base of the mating indicator lamp. The terminals of the socket are joined, as by wires of a wiring harness, to the corresponding contacts of the said simulated lamp base. Then, by replacing the vehicle lamp socket by the said simulated (i.e. adapter) socket, and plugging the simulated (i.e. adapter) base into the removed vehicle socket, a lamp in the simulated socket will be energized exactly as in the original vehicle arrangement. The harness is also provided with wires joined to the respective wires connecting the simulated base with the simulated socket and having a third end configured to be joined to the trailer light system, by way of an electrical trailer connector.

The objects and advantages of the present invention will become more evident from the following description of illustrative embodiments and the annexed drawings.

DESCRIPTION OF PREFERRED EMBODIMENTS

Figure 1:
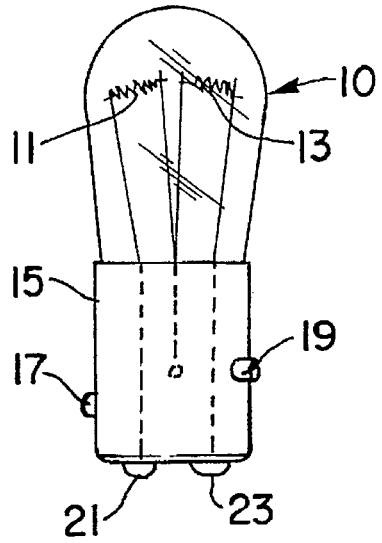
FIG. 1 shows a schematic depiction of a representative conventional vehicle indicator lamp, illustratively shown as a dual-filament tail lamp and stop/turn lamp.
Figure 2:
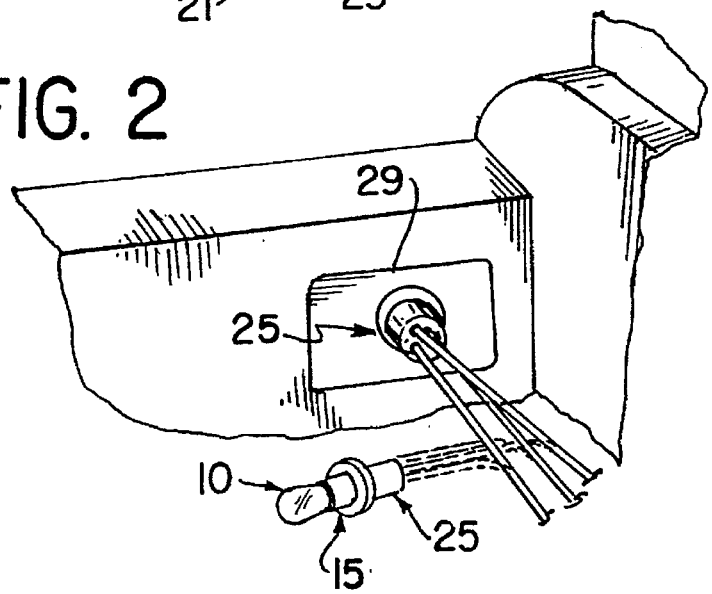
FIG. 2 shows a fragmentary perspective view of a representative conventional vehicle lamp mounting, viewed from the interior of the vehicle trunk.

Referring to the drawings, FIG. 1 shows a representative conventional dual-filament common-ground lamp 10 having a tail-light filament 11 and a stop/turn light filament 13. Lamp 10 has a base 15 with a pair of off-set retaining lugs 17, 19, which fit into corresponding "J slots" in the socket for this lamp. The lugs 17, 19 are not directly opposite one another, and the socket J-slots are of unequal depth to require inserting the lamp in the socket in only one way. The lamp base 15 has a pair of contacts 21,23 each connected to one end of a respective filament. The other ends of the filaments are connected together to a metallic sleeves forming part of the lamp base 15. The original vehicle socket 25 for this lamp 10 has two contacts which mate with the lamp contacts 21, 23, and a normally grounded tubular portion which contacts the lamp base sleeve. The socket 25 as shown as FIG. 2, is held in a mount or housing 29 in a rear wall of the vehicle. Typically, the socket 25 and lamp 10 mounted in it are removably held in mount 29.

Figure 3:
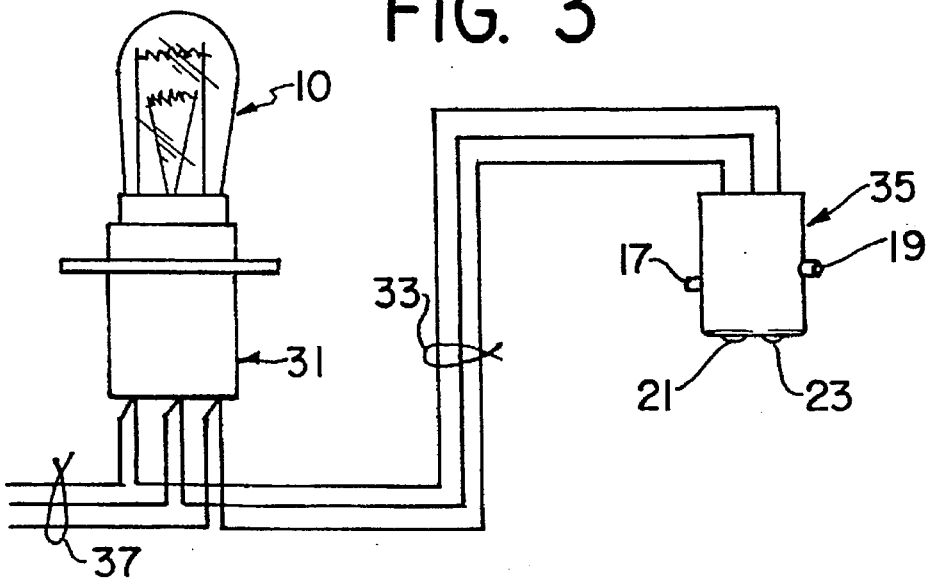
FIG. 3 shows schematically one embodiment of the present invention.

FIG. 3 diagrammatically shows the connector device of the present invention. It comprises a socket element 31 which is a replica or simulation of the vehicle socket 25. The connector socket element 31 is connected by wires 33 to a plug element 35 which is a replica or simulation of the base of lamp 10, and is essentially a dummy or adapter lamp base. The connector device also has wires 37 connected respectively to wires 33, which lead to the corresponding terminals of the lamp socket of the trailer, preferably by way of a separable connector 39 (FIG. 4).

Figure 4:
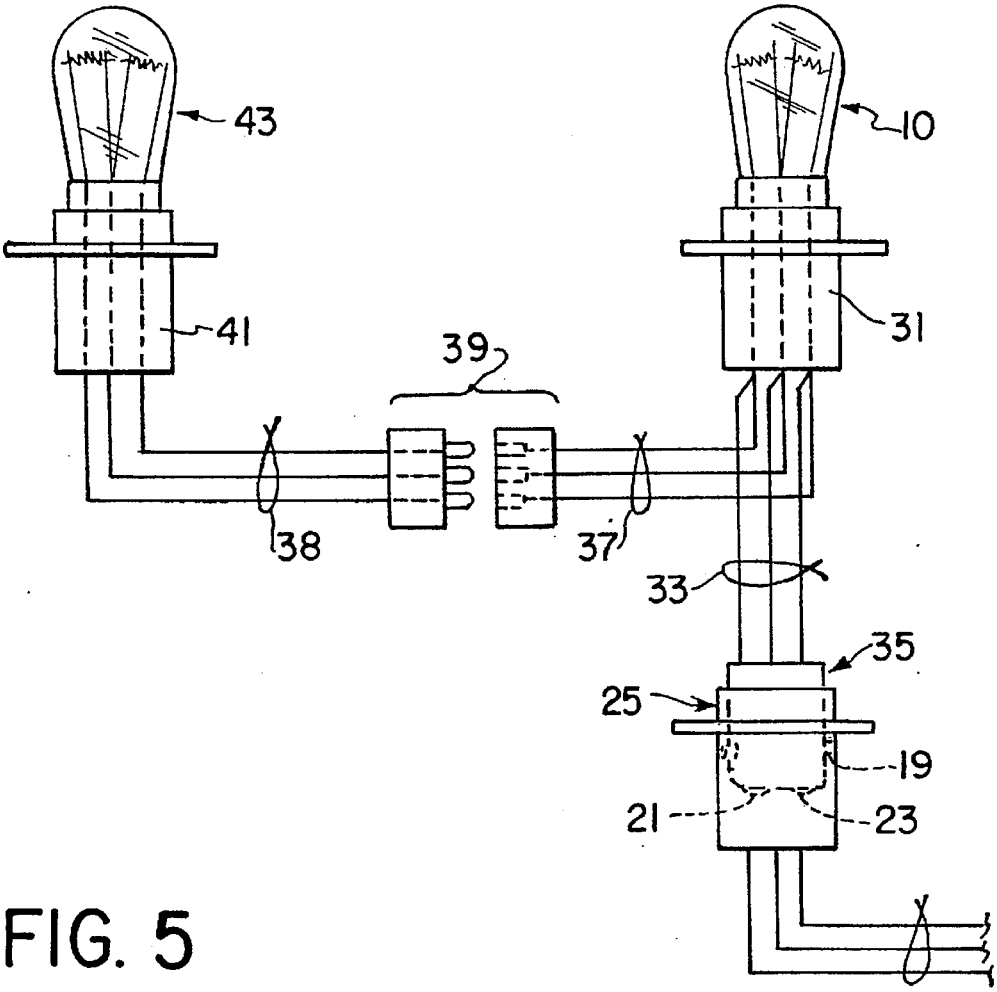
FIG. 4 shows schematically one form of the present invention as installed in a towing vehicle and trailer.
Figure 5:
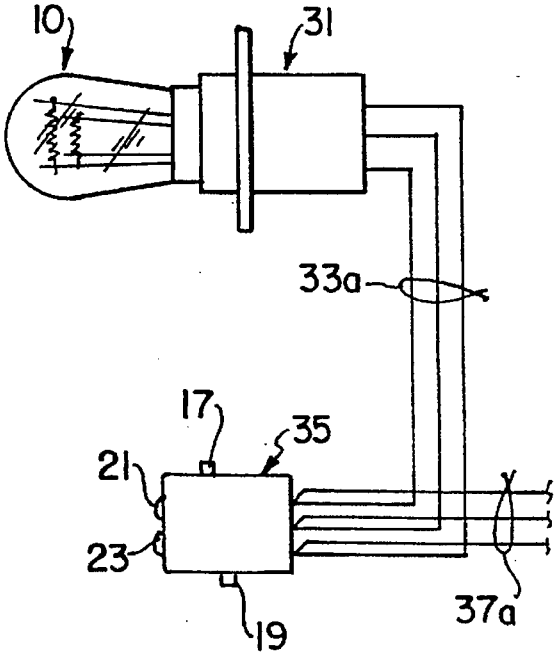
FIG. 5 shows schematically a first alternative arrangement of the device of FIG. 3.
Figure 6:
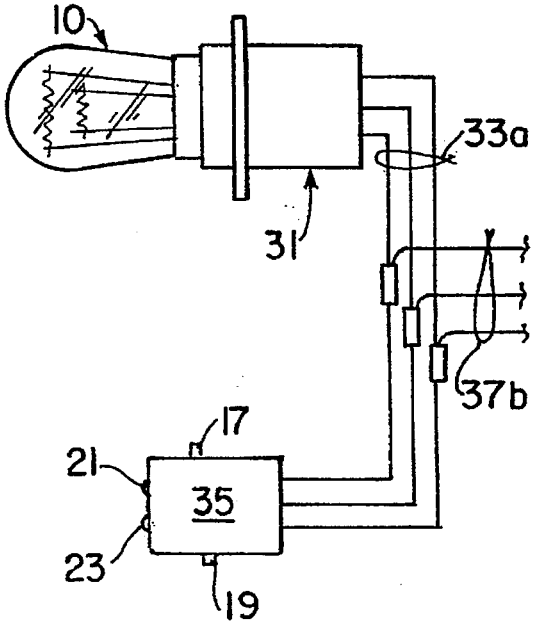
FIG. 6 shows schematically a second alternative arrangement of the device of FIG. 3.

FIG. 4 diagrammatically shows the present invention as installed. The vehicle socket 25 and lamp 10 are removed from the lamp mount. The lamp 10 is removed from vehicle socket 25 and placed into the adapter socket 31, which is placed into the vehicle lamp mount 29. The adapter plug 35 is then placed into the vehicle socket 25. The leads 37 (or, alternatively 37*a* or 37*b*) are shown leading to the trailer, as by being connected to a separable connector 39, which leads to the trailer socket 41 and to the trailer tail-, stop-, turn-light mounted therein. In this way, each vehicle lead 33 is directly connected to a corresponding trailer lead 37 and contact of trailer socket 41, without the need to search for or to cut or connect to individual wires. It will be understood that leads 37 may be connected to the trailer light system in any desired manner.

This description has related to the connection device as applied to a dual filament bayonet-base lamp. The device is equally adapted and adaptable to other lamp/socket configurations including single filament lamps and lamps having other base configurations such as wedge bases.

What is claimed is:

1. An adapter device for connecting a light circuit of a trailer to a towing vehicle having a socket opening configured to mount a removable electrical socket receiving a lamp, comprising an adapter socket configured to receive said lamp, and being configured to be substantially identical to said removable electrical socket so as to removably mount in said socket opening of said towing vehicle, an adapter plug having contacts conforming to those on said lamp and simulating the base of a lamp, an electrical connector configured to connect to said trailer light circuit, and wiring joining said socket, plug and electrical connector in parallel, with their corresponding terminals interconnected, whereby, upon substituting said adapter socket for the vehicle socket and inserting said plug into said vehicle socket and joining said electrical connector to the light circuit for said trailer, electrical power is supplied to both said adapter socket for illuminating said vehicle lamp and to said trailer light circuit.

2. An adapter device for connecting a light circuit of a trailer to a towing vehicle having a socket opening configured to mount a removable electrical socket receiving a lamp, comprising an adapter socket configured to receive said lamp, and being configured to be substantially identical to removable electrical socket so as to removably mount in said socket opening of said towing vehicle, an adapter plug having contacts conforming to those on said lamp and simulating the base of a lamp, first wiring connecting said adapted socket and plug, and additional wiring for connecting said first wiring to the trailer light system.

3. An adapter device as in claim 2, wherein said lamp is a dual-filament tail light and stop light having three contacts, and said first wiring has three wires, said additional wiring having three wires connected respectively to said first wiring wires.

4. An adapter device as in claim 2, where said additional wiring and first wiring are joined at said adapter socket.

5. A device as in claim 2, where said additional wiring and said first wiring are joined at said adapter plug.

6. A device as in claim 2, where said additional wiring and first wiring are joined intermediate said adapter socket and adapter plug.

7. An adapter device as in claim 2, where said lamp is a single-filament light having two contacts, and said first wiring has two wires, said additional wiring having two wires connected respectively to said first wiring wires.

* * * * *